United States Patent [19]

Sharpe

[11] 4,141,229

[45] Feb. 27, 1979

[54] KNIT CAP WITH ELASTIC HEAD BAND

[75] Inventor: L. Harold Sharpe, Albemarle, N.C.

[73] Assignee: Stanly Knitting Mills, Inc., Oakboro, N.C.

[21] Appl. No.: 840,767

[22] Filed: Oct. 11, 1977

[51] Int. Cl.[2] ..... A42B 1/04; D04B 1/24

[52] U.S. Cl. ..... 66/171; 2/201

[58] Field of Search ..... 66/171, 174–176, 66/172 E; 2/201, 202, 205, 195, 192, 198

[56] References Cited

U.S. PATENT DOCUMENTS

| | | | |
|---|---|---|---|
| 1,812,420 | 6/1931 | Weiner | 2/201 |
| 1,920,200 | 8/1933 | Karger | 2/201 |
| 2,143,265 | 1/1939 | Goldstein | 2/201 |
| 2,345,407 | 3/1944 | Marder et al. | 2/198 X |
| 2,417,986 | 3/1947 | Marder et al. | 2/198 |
| 3,503,077 | 3/1970 | Connelly | 66/171 X |

FOREIGN PATENT DOCUMENTS

| | | | |
|---|---|---|---|
| 602191 | 12/1925 | France | 2/198 |

*Primary Examiner*—Werner H. Schroeder
*Assistant Examiner*—Andrew M. Falik
*Attorney, Agent, or Firm*—Bell, Seltzer, Park & Gibson

[57] ABSTRACT

The cap includes a crown knit of body yarn stitches with a lower edge forming a band adapted to engage the head of the wearer. A visor extends throughout a minor portion of the band and elastic yarn is incorporated with the body yarn stitches in the major portion of the band to draw the head band into resilient engagement with the head of the wearer. The elastic yarn may be incorporated in the band by being knit in spaced courses and spaced wales to cause the body yarn stitches in the major portion of the band to be drawn together and form mock ribs therein.

10 Claims, 6 Drawing Figures

KNIT CAP WITH ELASTIC HEAD BAND

This invention relates generally to knit caps and more particularly to a knit cap and method of forming the same with an elastic head band which is integrally formed during the knitting of the cap.

Knit caps are usually formed by knitting an elongate seamless blank, folding one end of the tube within the other to form a double thickness crown with the folded lower edge forming a head band, sewing a relatively stiff visor in a minor portion of the head band, sewing an elastic tape in the major portion of the head band and from one end of the visor to the other, and then cutting and sewing the open end of the tube to close the crown of the cap. The sewing of the elastic tape in the lower edge of the head band is a time consuming and costly operation which requires a skilled operator. Unless the opposite ends of the elastic tape are firmly anchored at opposite ends of the visor, the elastic tape may pull free and thereby shorten the useful life of the cap. Also, the elastic tape may become displaced from the folded lower edge of the band and cause discomfort to the wearer.

With the foregoing in mind, it is an object of the present invention to provide a knit cap and method of forming the same with an integrally formed elastic head band so as to eliminate the need for sewing a separate elastic tape into the cap. To this end, elastic yarn is incorporated throughout a major portion of the head band during the knitting operation so that the major portion of the band is resiliently maintained in snug engagement with the head of the wearer.

In accordance with the present invention, the cap is formed by knitting an elongate seamless tubular blank of body yarn stitches while incorporating an elastic yarn with the body yarn stitches in a relatively narrow band positioned substantially equal distance between the opposed open ends of the seamless tubular blank. The elastic yarn may be incorporated by being knit in spaced courses and spaced wales in the major portion of the circumference of the narrow band to cause the body yarn stitches in spaced wales to be drawn together and form a mock rib appearance. In the minor portion of the narrow band in which the visor is to be incorporated, the elastic yarn forms long floats and the elastic yarn is knit in at least one wale intermediate the opposite ends of the minor portion of the narrow band. Half of the seamless blank is then folded within the other half to form a two-ply or double thickness tubular crown member with the inner and outer plies being integrally knit along a fold line extending through the narrow band with the elastic yarn incorporated therein and with the open ends of the inner and outer plies being juxtapositioned. The relatively stiff visor is then sewn in position along the fold line and between the inner and outer plies and in the minor portion of the band in which the elastic yarn is floated. The juxtapositioned open ends are then joined together to close the upper end of the crown of the cap with the elastic yarn incorporated in the major portion of the band drawing the same into resilient engagement with the head of the wearer.

Other objects and advantages will appear as the description proceeds when taken in connection with the accompanying drawings, in which FIG. 1 is a prospective view of the cap of the present invention;

Figure 3:
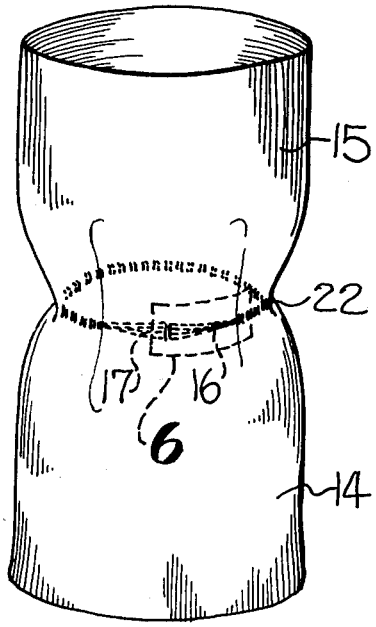
FIG. 3 is a prospective view of the seamless tubular blank from which the cap is formed.
Figure 5:
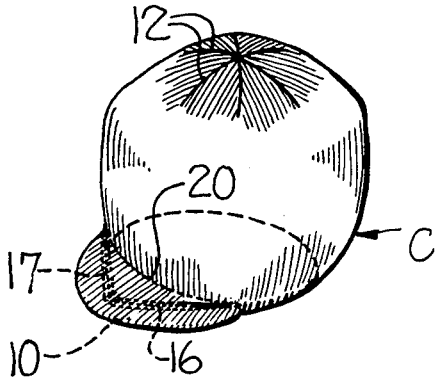
Figure 6:
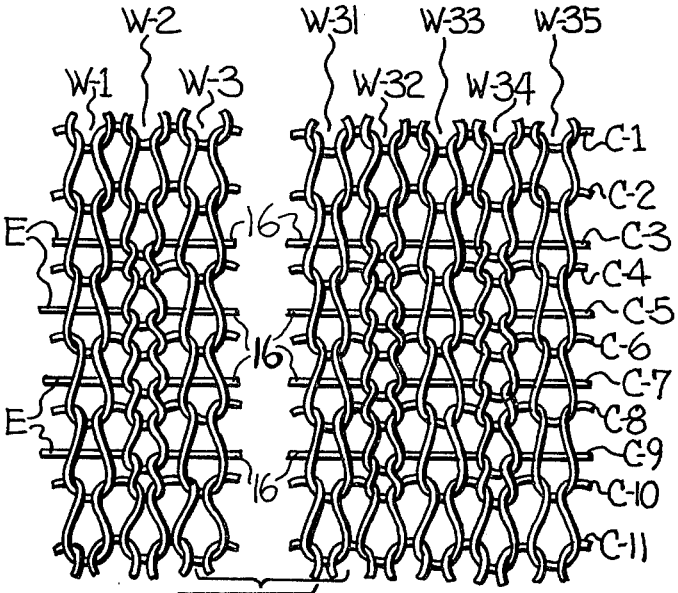

FIG. 5 is a prospective view of the cap with the visor being sewn in position in the seamless lower band portion of the cap with the upper ends being joined together to close the upper end of the crown; and FIG. 6 is a greatly enlarged fragmentary elevational view taken in the dash-dot rectangle 6 in FIG. 3 and illustrating the manner in which the elastic yarn is incorporated in the narrow head band in the medial portion of the seamless blank.

Figure 1:
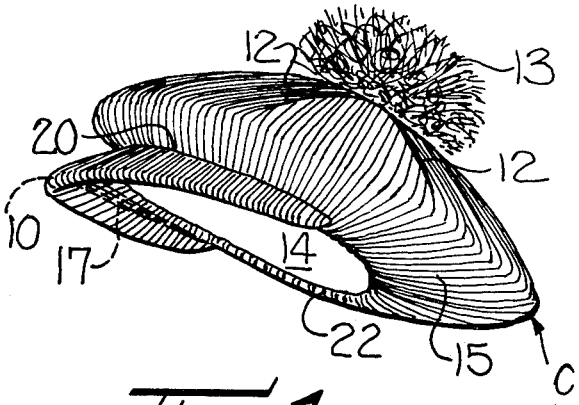
Figure 2:
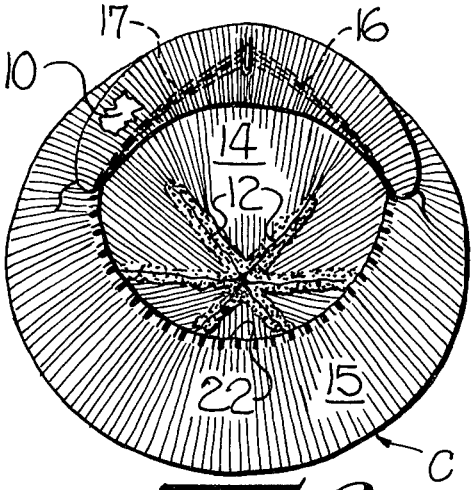
FIG. 2 is an elevational view of the bottom of the cap of the present invention.

The cap of the present invention includes a crown, broadly indicated at C, knit of body yarn stitches and having a lower edge forming a head band adapted to engage the head of the wearer. A visor 10 extends throughout a minor portion of the head band and an elastic yarn, indicated at E in courses C-3, C-5, C-7, and C-9 of FIG. 6 is incorporated with the stitch loops of the body yarn Y in the major portion of the head band to draw the same into resilient engagement with the head of the wearer. The crown C is closed at the upper end as by seams 12 and may include a decorative pom 13 (FIG. 1) attached thereto.

The crown C is preferably of a two-ply or double thickness construction and includes an inner ply 14 and an outer ply 15 (FIG. 4) which are integrally knit along their lower edges and joined along a fold line to form an elastic head band adapted to engage the head of the wearer. The elastic yarn E is incorporated with the stitch loops of the body yarn Y in the major portion of the head band, in a manner to be presently described, to draw the major portion of the head band into resilient engagement with the head of the wearer and to ensure that the cap remains in snug engagement with the head of the wearer.

The cap is formed by first knitting an elongate seamless tubular blank (FIG. 3) with open opposite ends and while incorporating the elastic yarn E with the stitch loops of the body yarn Y in a relatively narrow band position substantially equal distance between the open ends of the seamless tubular blank. The seamless tubular blank (FIG. 3) is preferably knit on a circular knitting machine and with the body yarn Y forming successive courses of wales of stitch loops which are illustrated as being plain jersey stitch loops in FIG. 6, but which may be rib stitch loops, if desired. The seamless tubular blank is described as being knit from the top to the bottom in FIGS. 3 and 6 so that the outer play 15 and inner ply 14 are successively knit with the body yarn Y to form successive courses of plain jersey stitch loops, as indicated in courses C-1, C-10 and C-11 of FIG. 6.

After knitting a sufficient number of courses to provide the proper length for the outer ply 15, the elastic yarn E is incorporated with the body yarn stitches in the major portion of the circumference of the narrow band by being knit in alternate courses (courses C-3, C-5, C-7 and C-9) and in alternate wales (wales W-32 and W-34) throughout the major portion of the circumference of the narrow band. The elastic yarn E is floated inside of the intervening wales (wales W-33 and W-35) and between the alternate wales in which it is knit (wales W-32 and W-34) to draw the stitch loops of body yarn Y together and form mock ribs, indicated at 22, extending around the major portion of the band. The elastic yarn E forms relatively long floats, indicated at 16 and 17, which extend inwardly from opposite ends of the major portion of the band. The elastic yarn floats 16, 17 are anchored by being interknit with the stitch loops of body yarn Y and intermediate the opposite ends of the minor portion of the band, as indicated in wale W-2 of courses C-3, C-5, C-7 and C-9.

Figure 4:
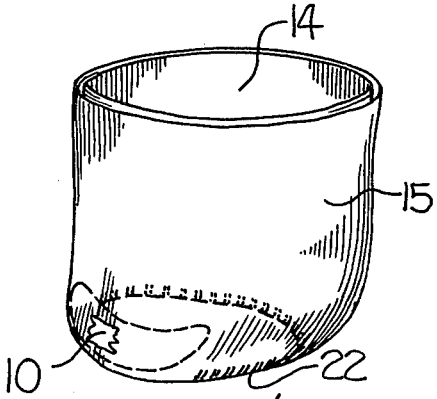
FIG. 4 is a prospective view of the seamless blank with the lower end being folded upwardly and within the upper end to form a double thickness with the visor being shown positioned between the two layers of fabric.

Upon completion of the knitting of the seamless blank, the lower end portion or inner ply 14 is folded upwardly inside of the upper end portion or outer ply 15, as illustrated in FIG. 4, and the relatively stiff, generally crescent-shaped, visor 10 is inserted between the inner and outer plies 14, 15. The visor 10 may be formed of any suitable material, such as plastic, and is sewn in position adjacent the fold line between the inner ply 14 and the outer ply 15 and in the minor portion of the band, as by a line of stitching indicated at 20 in FIGS. 1 and 5. Since the inner ends of the floats 16, 17 are anchored, by being interknit with the body yarn, they are maintained outwardly of the line of stitching 20 and extend between the lower surface of the visor 10 and the upper surface of the inner ply 14.

The juxtapositioned open upper ends of the inner and outer plies are then joined together by the seams 12 to close the upper end of the crown of the cap. If desired, a suitable ornament, such as the pom 13, may be attached to the closed upper portion of the crown of the cap.

Although the cap of the present invention has been described as being knit of plain jersey body yarn stitches, it is to be understood that other types of stitches may be employed in the knitting of the seamless blank and any suitable type of pattern or design may be employed during the knitting of the cap. While the elastic yarn E has been described as being incorporated with the stitch loops of body yarn Y by being knit to form independent stitch loops, it is to be understood that the elastic yarn E may be knit in plated relationship with the stitch loops of body yarn Y, or the elastic yarn E may be incorporated by other well-known means, such as by inlaying and the like.

In the cap of the present invention, an elastic head band extends throughout the major portion of the head band and is integrally knit with the band so that it is not necessary to attach a separate elastic tape in the cap. Since elastic head band is formed as an integral part of the cap, it will not pull loose and maintains snug engagement with the head of the wearer throughout the useful life of the cap.

In the drawings and specification there has been set forth a preferred embodiment of the invention, and although specific terms are employed, they are used in a generic and descriptive sense only and not for purposes of limitation, the scope of the invention being defined in the claims.

That which is claimed is:

1. In a visored cap including a crown knit of body yarn stitches and a lower edge providing a band adapted to engage the head of the wearer, and a visor extending throughout a minor portion of said band, the combination therewith of elastic yarn incorporated with the body yarn stitches in the major portion of said band and floating across the body yarn stitches substantially throughout the minor portion of said band, said elastic yarn being sufficient to draw the major portion of said band into resilient engagement with the head of the wearer.

2. In a visored cap according to claim 1 wherein said elastic yarn is incorporated with the body yarn stitches of the major portion of said band by being knit.

3. In a visored cap according to claim 1 wherein said elastic yarn is incorporated with the body yarn stitches of the major portion of said band by being knit in spaced courses and spaced wales to cause the body yarn stitches in said spaced wales to be drawn together and form mock ribs in said band.

4. In a visored cap including a crown knit of body yarn stitches and comprising inner and outer plies integrally knit along their lower edges to form a band adapted to engage the head of the wearer, and a visor extending throughout a minor portion of said band and being sewn in position between the inner and outer plies, the combination therewith of elastic yarn incorporated with the body yarn stitches in the major portion of said band and along the juncture of the inner and outer plies of said crown, said elastic yarn floating across the body yarn stitches substantially throughout the minor portion of said band, said elastic yarn being sufficient to draw the major portion of said band into resilient engagement with the head of the wearer.

5. In a visored cap according to claim 4 wherein said elastic yarn is floated on the inner surface of said inner ply and extends beneath said visor, and wherein said elastic yarn is incorporated in at least one wale of said inner ply and intermediate the ends of said visor.

6. In a visored cap according to claim 5 wherein said elastic yarn is incorporated with the body yarn stitches of the major portion of said band by being knit.

7. In a visored cap according to claim 5 wherein said elastic yarn is incorporated with the body yarn stitches of the major portion of said band by being knit in spaced courses and spaced wales to cause the body yarn stitches in said spaced wales to be drawn together and form mock ribs in said band.

8. A method of forming a visored cap comprising the steps of knitting an elongate seamless blank of body yarn stitches and including open opposite ends and while incorporating an elastic yarn with the body yarn stitches in a relatively narrow band positioned substantially equal distance between the open ends of the seamless tubular blank, the elastic yarn being incorporated with spaced body yarn stitches in the major portion of the circumference of the narrow band, the elastic yarn floating across the body yarn stitches substantially throughout the minor portion of the narrow band, folding half of the seamless tube within the other half to form a two-ply tubular member with the inner and outer plies being integrally knit along a fold line extending through the narrow band with the elastic yarn incorporated therein and the open ends of the inner and outer plies being juxtapositioned, inserting a visor between the inner and outer plies and sewing the same in position in the minor portion of the band in which the elastic yarn is floated, and joining together the juxtapositioned open ends to form a crown for said cap, the elastic yarn incorporated in the body yarn stitches in the major portion of the band drawing the same into resilient engagement with the head of the wearer.

9. A method according to claim 8 including the step of incorporating the elastic yarn with spaced body yarn stitches of the major portion of the narrow band by knitting the elastic yarn in spaced wales and spaced courses to cause the body yarn stitches in the spaced wales to be drawn together and form mock ribs in the band.

10. A method according to claim 9 including the step of floating a elastic yarn throughout the major portion of the minor portion of the narrow band and knitting the elastic yarn in at least one wale intermediate opposite ends of the minor portion of the narrow band.

* * * * *